US009057555B2

(12) United States Patent
Moody et al.

(10) Patent No.: US 9,057,555 B2
(45) Date of Patent: Jun. 16, 2015

(54) TOOL REMOVABLE ADJUSTABLE DIVIDER

(75) Inventors: William Lee Moody, Anderson, SC (US); Michael Bayne, Easley, SC (US); Jeremiah Stamey, Easley, SC (US)

(73) Assignee: ELECTROLUX HOME PRODUCTS, INC., Cleveland, OH (US)

( * ) Notice: Subject to any disclaimer, the term of this patent is extended or adjusted under 35 U.S.C. 154(b) by 249 days.

(21) Appl. No.: 12/902,581

(22) Filed: Oct. 12, 2010

(65) Prior Publication Data

US 2011/0219807 A1 Sep. 15, 2011

Related U.S. Application Data

(63) Continuation of application No. 12/714,134, filed on Feb. 26, 2010, now abandoned.

(51) Int. Cl.

| | |
|---|---|
| ***F25D 11/02*** | (2006.01) |
| ***F25D 25/02*** | (2006.01) |
| ***A47B 57/58*** | (2006.01) |

(52) U.S. Cl.

CPC ..... *F25D 25/022* (2013.01); *A47B 57/581* (2013.01); *A47B 57/58* (2013.01); *A47B 57/583* (2013.01); *A47B 57/586* (2013.01); *F25D 25/025* (2013.01)

(58) Field of Classification Search

CPC ..... A47B 57/58–57/586

USPC ..... 312/402, 404, 330.1, 311, 228.1, 298, 312/301–302, 348.3, 407; 211/184, 41.9, 211/59.2, 59.3, 88.01, 90.03, 126.15, 126.9, 211/133.5, 181.1; 108/60, 61

See application file for complete search history.

(56) References Cited

U.S. PATENT DOCUMENTS

| | | | |
|---|---|---|---|
| 1,906,191 | A | 4/1933 | Bertram et al. |
| 2,155,284 | A | 4/1939 | Steenstrup |
| 2,615,592 | A | 10/1952 | Swedman |
| 3,929,248 | A | 12/1975 | Morrison |

(Continued)

FOREIGN PATENT DOCUMENTS

| | | | |
|---|---|---|---|
| CN | 2881480 | Y | 3/2007 |
| EP | 1925744 | A1 * | 5/2008 |

(Continued)

OTHER PUBLICATIONS

English translation of EP 1,925,744 provided by EPO.*

(Continued)

*Primary Examiner* — John F Pettitt
*Assistant Examiner* — Tareq Alosh
(74) *Attorney, Agent, or Firm* — Pearne & Gordon LLP

(57) ABSTRACT

Provided is a basket for storing food items in a temperature-controlled environment and a refrigeration appliance including such a basket. The basket includes a substantially-horizontal platform coupled to two or more upwardly-extending walls to form an open container for receiving the food items to be stored in the temperature-controlled environment. A partition is provided for dividing the basket into two or more storage regions. A guide is coupled to at least one of the platform and the walls, and extends substantially parallel to an upper perimeter of at least one of the walls to define a range of adjustment of the partition. A fastener securely couples the partition to the guide to be adjusted to two or more different locations where the partition is to divide the basket.

14 Claims, 5 Drawing Sheets

(56) References Cited

U.S. PATENT DOCUMENTS

| | | | | |
|---|---|---|---|---|
| 4,190,167 | A * | 2/1980 | Wells et al. | 211/184 |
| 4,331,243 | A | 5/1982 | Doll | |
| 5,303,997 | A | 4/1994 | Kropf | |
| 6,224,176 | B1 * | 5/2001 | Suzuki | 312/278 |
| 6,691,382 | B1 * | 2/2004 | Su | 24/545 |
| 6,971,730 | B2 * | 12/2005 | Koons | 312/404 |
| 7,197,888 | B2 | 4/2007 | LeClear et al. | |
| 7,296,433 | B2 | 11/2007 | Uihlein et al. | |
| 2003/0173882 | A1 | 9/2003 | Koons | |
| 2005/0269921 | A1 * | 12/2005 | Remmers | 312/330.1 |
| 2006/0051477 | A1 | 3/2006 | Sann | |
| 2006/0250062 | A1 | 11/2006 | Janda et al. | |
| 2008/0314067 | A1 | 12/2008 | Lee | |
| 2009/0026906 | A1 * | 1/2009 | Kim | 312/401 |
| 2009/0302728 | A1 * | 12/2009 | Rotter et al. | 312/404 |

FOREIGN PATENT DOCUMENTS

| | | | |
|---|---|---|---|
| GB | 1449281 A * | 9/1976 | |
| WO | 0226082 | 4/2002 | |
| WO | WO 0226082 A1 * | 4/2002 | |
| WO | 2008/135391 A1 | 11/2008 | |

OTHER PUBLICATIONS

English translation of EP 1,925,744 provided by EPO. [Translation run Aug. 2013].*

International Search Report for PCT/US2011/026163, dated Jul. 18, 2011, 2 pages.

Office Action cited in corresponding Chinese Patent Application No. 201180019326.3 dated Jun. 26, 2014.

Office Action from corresponding Russian Patent Application No. 2012141049.

Translation of Notice of Grant in Russian Patent Application No. 2012141049.

Ehpplajd Dizajn Ehnd Inzhiniri, English-language Abstract of Patent No. RU2290576C2, Published Dec. 27, 2006.

* cited by examiner

TOOL REMOVABLE ADJUSTABLE DIVIDER

BACKGROUND OF THE INVENTION

1. Field of the Invention

This application relates generally to a basket for a refrigeration appliance, and more specifically to a basket including a partition that is adjustable to a plurality of different positions relative to the basket without fully disconnecting the partition from the basket.

2. Description of Related Art

One configuration of a conventional refrigeration appliance includes a freezer compartment that is disposed vertically below the fresh food compartment. Such a configuration is convenient since most visits to the refrigeration appliance involve inserting or removing items to/from the fresh food compartment. Placing the fresh food compartment above the freezer compartment positions the most-frequently used items at eye level, making them readily accessible.

Conventional refrigeration appliances typically include a basket for storing frozen food items within the freezer compartment. The basket can be divided into a plurality of different zones by a partition installed between the lateral sides of the basket. However, permanently installing the partition at a fixed location prevents users from customizing the arrangement of food in the freezer compartment to suit their own particular needs.

To make the basket customizable, the partition has been made removable, allowing users to completely remove the partition from the basket by hand, and reinstall it by hand at a desired location. Such conventional partitions have a clip at each of its opposite ends to cooperated with one or more wires forming the basket. Users can grasp the partition and move it by hand to separate the clips from the basket wires and completely remove the partition from the basket. However, the partitions can be easily misplaced when removed from the basket.

SUMMARY

Accordingly, there is a need in the art for a refrigeration appliance including a basket for storing food items and a partition for dividing the basket into a plurality of different bins. The partition can optionally be securely coupled to the basket by a fastener preventing hand removal of the partition without the aid of a tool.

According to one aspect, the subject application involves a basket for storing food items in a temperature-controlled environment. The basket includes a substantially-horizontal platform coupled to two or more upwardly-extending walls to form an open container for receiving the food items to be stored in the temperature-controlled environment. A partition is provided for dividing the basket into two or more storage regions. A guide is coupled to at least one of the platform and the walls, and extends substantially parallel to an upper perimeter of at least one of the walls to define a range of adjustment of the partition. A fastener securely couples the partition to the guide to be adjusted to two or more different locations where the partition is to divide the basket.

According to another aspect, the subject application involves a refrigeration appliance including a fresh food compartment for storing food items in a refrigerated environment having a target temperature above zero degrees Centigrade, and a freezer compartment disposed at an elevation vertically below the fresh food compartment for storing food items in a freezing environment having a target temperature below zero degrees Centigrade. A refrigeration system provides a cooling effect to the fresh food compartment and the freezer compartment, and a freezer drawer includes a basket that can be at least partially extracted from the freezer compartment to expose food items stored within the freezer compartment. The basket includes a substantially-horizontal platform coupled to a plurality of upwardly-extending walls to form an open container for receiving the food items to be stored in the freezer compartment, and a partition for dividing the basket into a plurality of storage regions. A guide is coupled to at least one of the platform and the sides. The guide extends substantially parallel to an upper perimeter of at least one of the sides and defining a range of adjustment of the partition. A fastener securely couples the partition to the guide to allow the partition to be adjusted to a plurality of different locations where the partition is to divide the basket.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

DETAILED DESCRIPTION

Figure 1A:
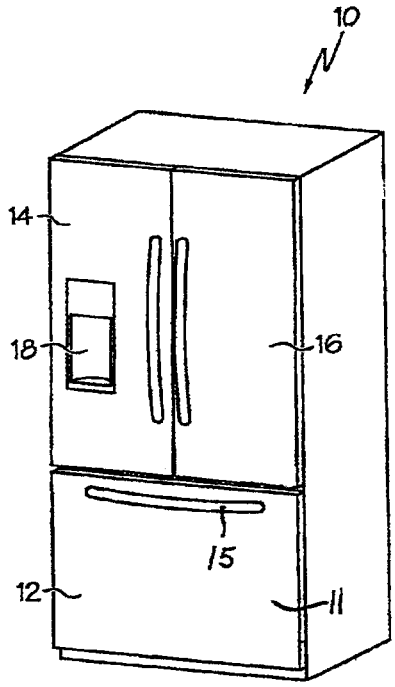
FIG. 1A shows a perspective view of an embodiment of a refrigerator including a freezer compartment disposed vertically below a fresh food compartment, the freezer compartment including a basket for storing food items within the freezer compartment.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

It is also to be noted that the phrase "at least one of", if used herein, followed by a plurality of members herein means one of the members, or a combination of more than one of the members. For example, the phrase "at least one of a first widget and a second widget" means in the present application: the first widget, the second widget, or the first widget and the second widget. Likewise, "at least one of a first widget, a second widget and a third widget" means in the present application: the first widget, the second widget, the third widget, the first widget and the second widget, the first widget and the third widget, the second widget and the third widget, or the first widget and the second widget and the third widget.

FIG. 1A shows an illustrative embodiment of a refrigeration appliance 10. The refrigeration appliance 10 shown in FIG. 1A is a so-called bottom-mount refrigerator, where a fresh-food compartment 20 (FIG. 1B) is disposed vertically above a freezer compartment 24. A pair of French doors 14, 16 restricts access to an interior of the fresh-food compartment 20 and are pivotally coupled with hinges to opposite lateral sides of a cabinet 22 housing the fresh-food compartment 20. A dispenser 18 can optionally be provided to one of the doors 14, 16 to dispense at least one of water and ice from the refrigeration appliance 10 without requiring the doors 14, 16 to be opened. Ice dispensed through the dispenser 18 can be made by, and delivered from an icemaker disposed within the fresh food compartment 20 of the refrigeration appliance 10. Likewise, water dispensed through the dispenser 18 can optionally be filtered by a water filter disposed within the fresh food compartment 20 of the refrigeration appliance 10.

A freezer door 12 is coupled to a basket 42 (FIG. 2) formed from a network of wires that is disposed within the insulated freezer compartment 24, which is arranged vertically beneath the fresh food compartment 20. A handle 15 is provided to an external side of the freezer door 12 to be grasped by a user and pulled outwardly to at least partially extract the freezer basket from within the freezer compartment 24, thereby making the contents of the freezer basket accessible. The freezer basket can be slidably mounted within the freezer compartment 24 with ball-bearing drawer slides such as those manufactured by Accuride International Inc., of Santa Fe Springs, Calif. Pulling the handle 15 will move the freezer door 12 outwardly away from the freezer compartment 24 and cause the basket 42 to travel along a track defined by the slide rails to it least partially expose the contents of the freezer basket 42.

Figure 1B:
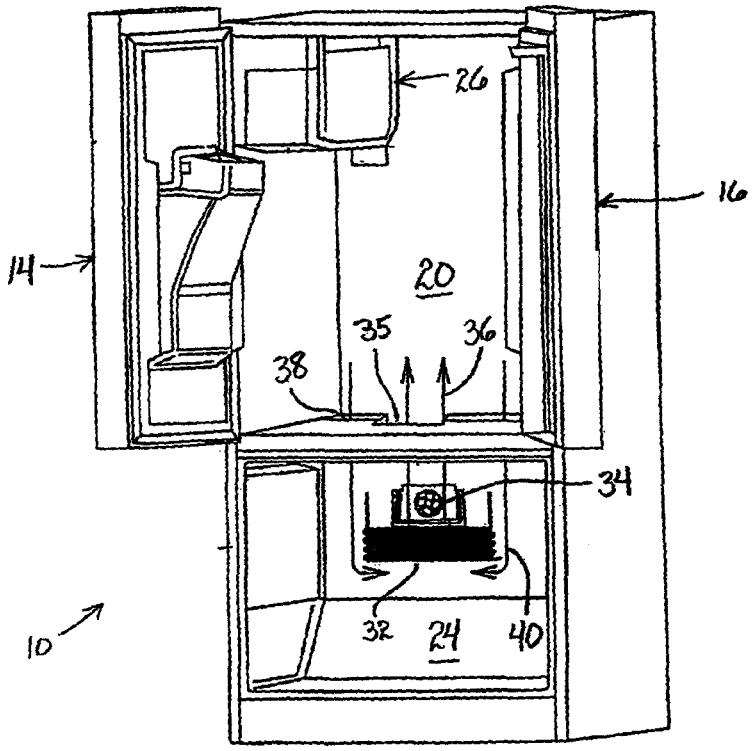
FIG. 1B shows a perspective view into an interior of the fresh food and freezer compartments of the embodiment of the refrigeration appliance shown in FIG. 1A.

As shown in FIG. 1B, a system evaporator 32 is exposed to, and in thermal communication with the interior of the freezer compartment 24. Refrigerant compressed by a compressor (not shown) evaporates within the system evaporator 32 to cool air being blown over the system evaporator 32 by a circulation fan 34 to be introduced into the fresh food compartment 20 and the freezer compartment 24. The cool air is blown upward through an air duct 35 formed in the insulation and extending between the fresh food and freezer compartments 20, 24 in the direction of arrows 36 to provide a cooling effect to the fresh food compartment 20. Air circulated through the fresh food compartment 20 can be returned to the freezer compartment 24 through a pair of return ducts 38 also extending between the fresh food and freezer compartments 20, 24 in the direction of arrows 40. The cool air from the system evaporator 32 is circulated as needed to maintain the refrigerated environment within the fresh food compartment 22 within an acceptable tolerance of a target temperature that is lower than room temperature but above zero degrees Centigrade. The cool air also maintains temperature was in the freezer compartment 24 within an acceptable tolerance of a target temperature that is less than zero degrees Centigrade.

Figure 2:
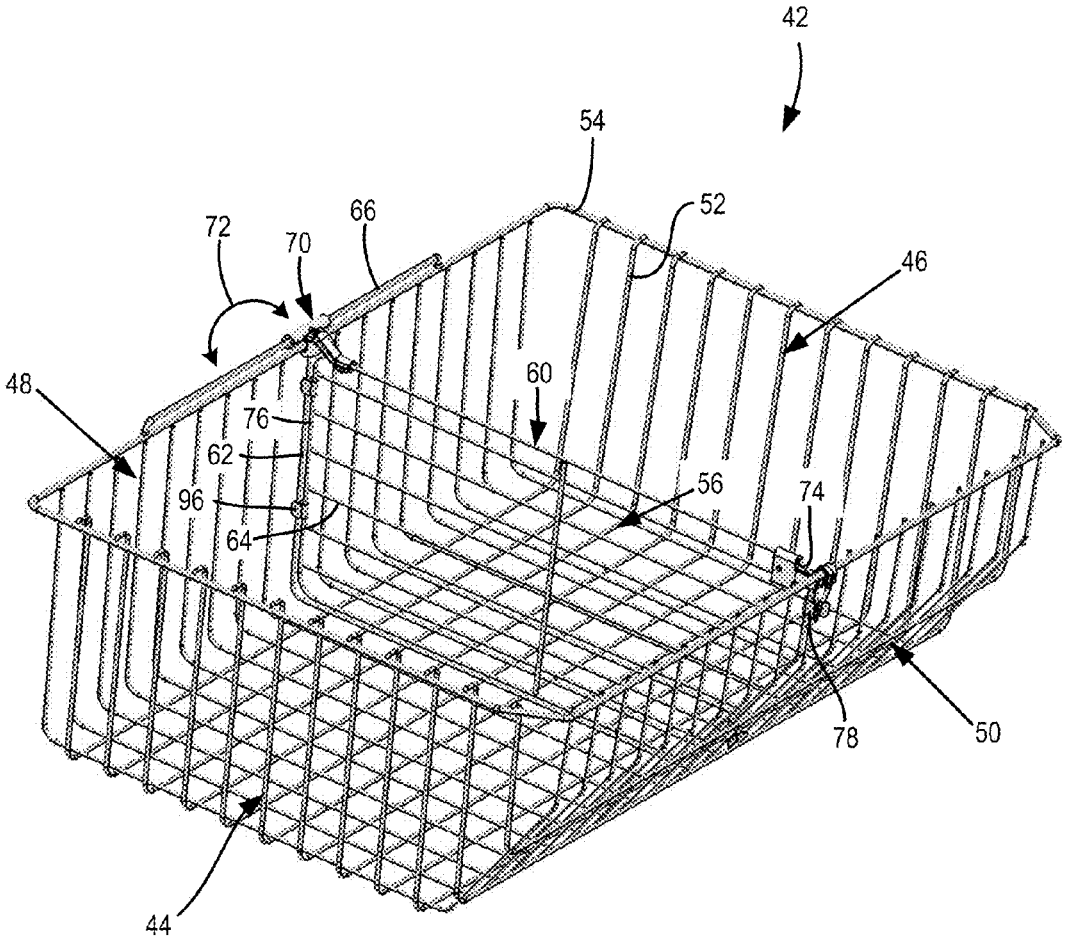
FIG. 2 shows a perspective view of an embodiment of a basket including a tool-removable partition adjustably coupled to the basket to allow lateral adjustment of the partition between lateral ends of the basket.

Referring once again to the embodiment shown in FIG. 2, the basket 42 includes a plurality of upwardly extending walls, including lateral sides 44, 46, a front wall 48 and a rear wall 50. Each of the walls is formed from a network of wires, including wires 52 extending between an upper periphery 54 of the basket 42 through which food items can be placed therein and a substantially horizontal bottom platform 56 on which the food items are to rest. The wires 52, although shown substantially vertical in FIG. 2, can be oriented in any suitable orientation to form the basket 42. Further, materials other than the network of wires 52 can be used to form the basket 52, but apertures can optionally be formed in such materials to facilitate air circulation to food items within the basket 42.

A partition 60 is provided to divide the basket 42 into a plurality of storage regions. As shown in FIG. 2, the partition 60 includes a wire frame 62 and a plurality of intermediate wires 64 extending between portions of the wire frame 62. As shown, the partition 60 extends in a depth dimension between the front side 48 and the rear side 50 of the basket 42. However, alternate embodiments of the partition 60 can extend transversely across a width dimension of the basket 42 instead of in the depth dimension without departing from the scope of the invention.

A guide 66 is coupled to at least one of the platform 56 and the walls 44, 46, 48, 50 to define an allowable range of adjustment of the partition relative to the lateral sides 44, 46 of the basket 42. In FIG. 2, the guide 66 is a generally cylindrical extension of wire similar to the wire forming the upper periphery 54 of the basket 42. The wire used for the upper periphery 54 and guide 66 can optionally be of a heavier gauge than the wires 52 used for the walls 44, 46, 48, 50 and the platform 56, for example. The guide 66 extends substantially parallel to the upper periphery of the front wall 48, which is to be disposed adjacent to the freezer door 12 when installed in the refrigeration appliance 10, but other embodiments can include a guide 66 extending adjacent to, or optionally parallel to the upper periphery 54 of at least one of the walls 44, 46, 48, 50 to define an allowable range of adjustment for the partition 60 within the basket 42.

The guide 66 extends along a center portion of the front wall 48 where it is common for the partition 60 to be located, but stops short of each of the lateral side walls 44, 46. For example, it may be undesirable to divide the basket 42 with the petition 60 to create a storage region smaller than 25% of the width of the basket 42. In the present example, the guide 66 can extend from a location about 25% of the distance between the lateral sides 44, 46 to a location about 75% of the distance between the lateral sides 44, 46. For such an example, the guide 66 is positioned to allow adjustment of the partition 60 along the middle 50% of the distance between the lateral walls 44, 46.

A fastener 70 securely couples the partition 60 to the guide 66 to allow adjustment of the partition 60 in the lateral direction in FIG. 2 to a plurality of different locations where the partition is to divide the basket 42. The fastener 70 can optionally pivotally couple the partition 60 to the guide 66, allowing the partition 60 to be pivoted about the guide 66 in the directions indicated by arrow 72 to selectively engage and disengage an end 74 the partition 60 opposite an end 76 adjacent to the fastener 70 with the rear wall 50.

Figure 5:
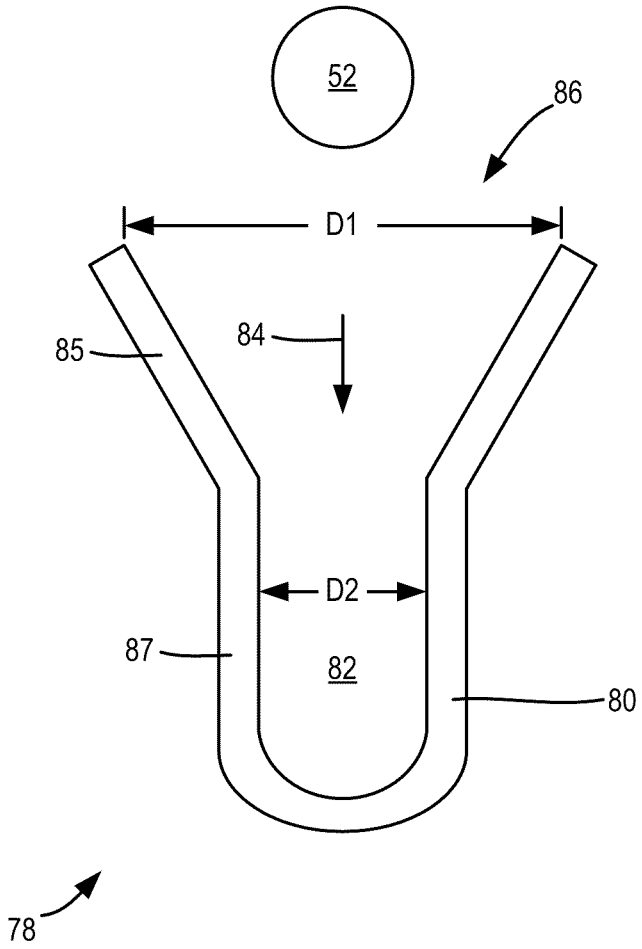
FIG. 5 is a top view of an embodiment of a clip including a flared entry.

With the end 74 of the partition 60 engaged with the rear wall 50, a clip 78 can cooperate with a portion of the rear wall 50 or other portion of the basket 42 to interfere with lateral adjustment of the partition 60 within the basket 42. The clip 78, a top view of which is shown in FIG. 5, includes a generally U-shaped metallic member 80 forming a generally U-shaped recess 82 in which a wire 52 of the rear wall 50 can be received in the direction of arrow 84 to engage the end of the partition 60 with the rear wall 50. The clip 78 can optionally be provided with a flared opening, which includes at least one angled portion 85 extending from the substantially parallel portions 87. The distance D1 between ends of the angled portions 85 forming the entrance 86 to the clip 78 is greater than a distance D2 separating the substantially parallel portions 87 forming the generally U-shaped recess 82. The greater distance D1 at the entrance 86 can minimize the accuracy needed by a user to engage the end 74 of the partition with the rear wall 50. Once the partition 60 has been pivoted about the guide 66 to place the entrance 86 about the wire 52, contact between the angled portions 85 of the flared opening will urge the partition 60 into proper alignment with the wire 52, allowing engagement between the end 74 of the partition and the rear wall 50 to be established.

Figure 3:
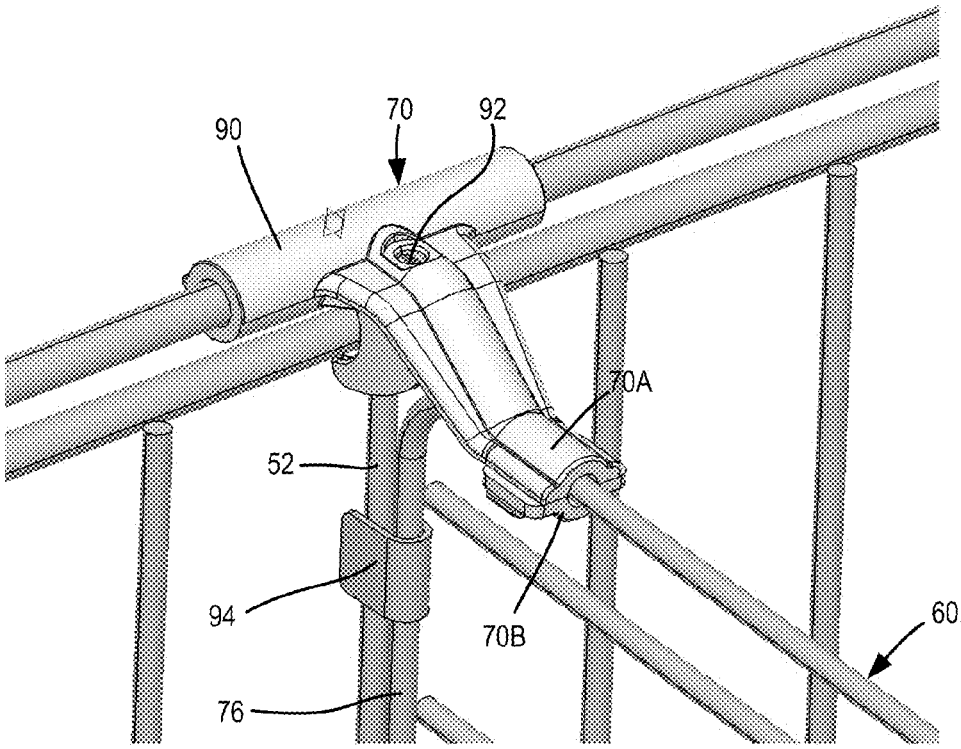
FIG. 3 is a top perspective view of an embodiment of a fastening system for securely coupling a partition to a basket in which food items are to be stored in a freezer compartment of a refrigeration appliance.
Figure 4:
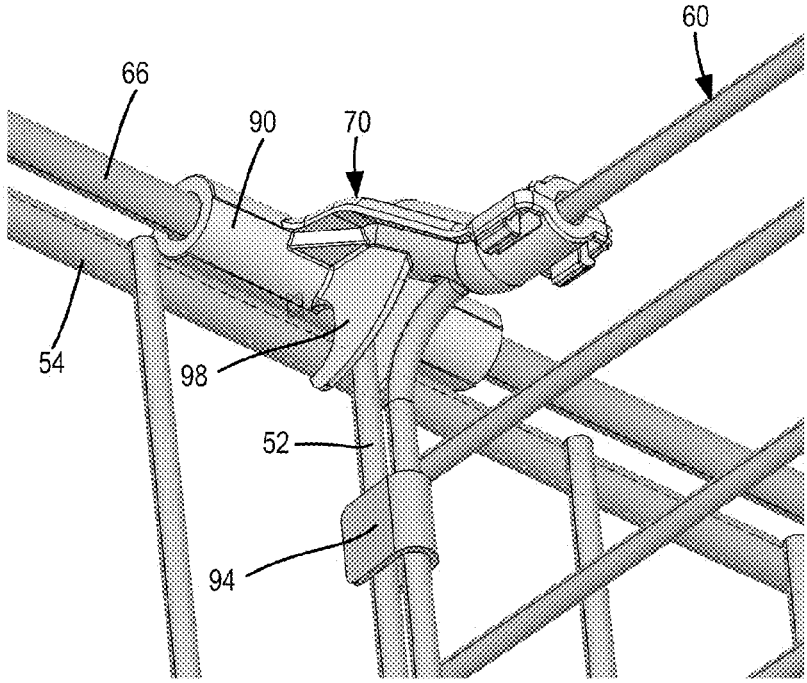
FIG. 4 is a bottom perspective view of the embodiment of the fastening system shown in FIG. 3.

An embodiment of the fastener 70 is illustrated in FIGS. 3 and 4. As shown, the fastener includes an annular receiver 90 that extends at least partially around the cylindrical member of the guide 66 to pivotally couple the partition 60 to the basket 42. The receiver 90 in FIGS. 3 and 4 extends entirely around the guide 66, and defines a sleeve that slides along the guide 66 to adjust the position of the partition 60 within the basket 42, but other embodiments can optionally extend a portion, but less than all of the way around the guide 66. To facilitate installation of the fastener 70, it can include a top portion 70A pivotally coupled to a bottom portion 70B in a clam-shell arrangement. A locking mechanism 92, shown in FIG. 3 as a threaded screw, can be inserted into the top and bottom portions 70A, 70B to secure those two portions together and coupling the partition 60 to the guide 66. Use of the screw or other suitable locking mechanism 92 requires the use of a screwdriver or other suitable unlocking tool to unlock the fastener 70 and completely separate and remove the partition from the basket 42. Thus, the partition 60 is said not to be hand removable, capable of being completely removed and separated from the basket 42 simply by manipulating and lifting on the partition 60 by hand. However, the receiver 90 allows pivotal adjustment of the partition 60 about the guide 66 when the locking mechanism 92 is in place and securing the top and bottom portions 70A, 70B of the fastener 70 together to securely couple the partition 60 to the basket 42. But despite the pivotal adjustment, the partition 60 remains coupled to the basket 42.

A clip 94, similar to clip 78, can also optionally be provided to the end 76 of the partition 60 adjacent to the fastener 70. The clip 94, as well as the clip 78 provided adjacent to the other end 74 of the partition 60, cooperate with respective wires 52 to resist forces imparted by food items within the basket 42 to interfere with lateral adjustment of the partition 60 when the end 74 is engaged with the rear wall 50. Providing the clips 78, 94 at both longitudinal ends 74, 76 of the partition 60 provides stability to both of such ends 74, 76. Likewise, one or more additional clips 96 (FIG. 2) can optionally be provided at one or both ends 74, 76 of the partition 60, but at a depth within the basket 42 closer to the platform 56 than the clips 78, 94.

FIG. 4 is a bottom view of the embodiment of the fastener 70 shown in FIG. 3. A hook 98 projects in a generally downward direction from an underside of the fastener 70. When the end 74 of the partition 60 is engaged with the rear wall 50, the hook 98 extends at least partially under the upper periphery 54 of the front wall 48 to maintain a relationship between the guide 66 and that portion of the upper periphery 54, such as when a heavy load in the basket 42 flexes that portion of the upper periphery 54. The hook can also make contact with the wire 52 to thereby provide further interference with the lateral adjustment of the partition 60.

The embodiments described above include a guide 66 in the form of a cylindrical member, but other embodiments can include any suitable guide that allows adjustment of the location of the partition 60 without complete separation and removal of the partition from the basket 42 without the aid of an unlocking tool. For example, the guide can be a portion of the wire forming the upper periphery 54 itself, or can be a female recess formed in a portion of the basket 42, capable of receiving a male portion of a fastener, for example. Likewise, the locking mechanism 92 is described as a threaded screw above, but again, the locking mechanism is not so limited. Any suitable locking mechanism that requires more than the simple lifting of the partition by hand, optionally requiring the use of an unlocking tool, to remove the partition 60 is considered within the scope of the present invention. Additionally, the refrigeration appliance 10 can optionally be provided with a basket 42 including the adjustable partition 60 described herein as one of a plurality of baskets within the freezer compartment 24. For example, the basket 42 including the adjustable partition 42 can be provided as the lowermost, and optionally largest basket in the freezer compartment 24. One or more additional baskets supported above the basket 42 including the adjustable partition 60 can optionally lack the adjustable partition 60, instead, including a hand-removable partition.

Illustrative embodiments have been described, hereinabove. It will be apparent to those skilled in the art that the above devices and methods may incorporate changes and modifications without departing from the general scope of this invention. It is intended to include all such modifications and alterations within the scope of the present invention. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A basket for storing food items in a temperature-controlled environment, the basket comprising:

a substantially-horizontal platform coupled to a plurality of upwardly-extending walls to form an open container for receiving said food items to be stored in said temperature-controlled environment;

a laterally adjustable partition for dividing said basket into a plurality of storage regions;

a guide coupled to said container, wherein said guide comprises a guide member and a guide attachment, wherein said guide member is spaced apart from an upper periphery of said container by said guide attachment and wherein said guide member extends substantially parallel to said upper periphery, wherein said guide member comprises an elongated cylindrical member extending along a portion of an upper perimeter of a wall of said basket, wherein said cylindrical member extends along a middle portion of said upper perimeter of said wall of said basket and terminates short of each lateral side of said basket, wherein the middle portion has a length of about 50% of the upper perimeter of said wall of said basket, wherein said guide attachment comprises a first connection member and a second connection member, the first connection member being connected at a first end of the guide member and to the upper periphery of the container, the second connection member being connected at a second end of the guide member and to the upper periphery of the container, wherein the guide member extends a first distance parallel to said upper periphery between the first connection member and the second connection member, wherein the first distance is greater than a second distance, wherein the second distance is defined as parallel to said first distance and between at least two wires forming the container; and a fastener, wherein said fastener is coupled to said partition and coupled to said guide member, and wherein said fastener comprises a locking mechanism which permits unlocking thereof with an unlocking tool, and wherein the partition is configured to be laterally adjustable along the guide member between the first connection member and the second connection member without unlocking the locking mechanism.

2. The basket according to claim 1, wherein at least one of said platform or at least one of said walls is formed from a network of wires.

3. The basket according to claim 2, wherein said platform and said walls are formed from a network of wires.

4. The basket according to claim 1, wherein said partition comprises a wire frame and a plurality of wires, wherein said plurality of wires extends between portions of said wire frame.

5. The basket according to claim 1, wherein said partition comprises a clip, wherein said clip is located adjacent to a second end of said partition and opposite to a first end of said partition, wherein said first end is coupled to said guide by said fastener, and wherein said clip comprises a generally U-shaped recess for receiving a wire forming a portion of at least one of said platform or at least one of said walls of said basket.

6. The basket according to claim 5, wherein said clip is configured to align the partition with at least one wire forming a portion of at least one of said platform or at least one of said walls of said basket.

7. The basket according to claim 1, wherein said fastener comprises:

an annular receiver that extends at least partially around said guide member to pivotally couple said partition to said guide member of said basket, without unlocking the locking mechanism.

8. The basket according to claim 5, wherein said clip comprises a hook portion for cooperating with a perimeter of said basket and a second portion for cooperating with a wire forming a portion of a rear wall of said basket to restrict lateral adjustment of said partition.

9. The basket according to claim 1, wherein said unlocking decouples said fastener from said guide member such that said partition is fully removable from said basket.

10. The basket according to claim 8, wherein said partition is configured to align with the wire forming a portion of a rear wall of said basket to restrict lateral adjustment of said partition.

11. The basket according to claim 1, wherein the partition aligns with a vertical wire of the basket when the partition is arranged in the basket to divide the basket into the plurality of storage regions.

12. The basket according to claim 1, wherein the at least two wires forming the container form at least a portion of an upwardly-extending wall and are arranged between the first connection member and the second connection member.

13. The basket according to claim 1, wherein the partition is configured to be laterally adjustable along the entire length of the guide member, without unlocking the locking mechanism.

14. The basket according to claim 1, wherein the partition is configured to be laterally adjustable along at least a majority of a distance between opposing walls of the plurality of upwardly-extending walls, without unlocking the locking mechanism.

* * * * *